US011306589B2

(12) United States Patent
Tonnqvist et al.

(10) Patent No.: US 11,306,589 B2
(45) **Date of Patent: *Apr. 19, 2022**

(54) MECHANISM AND METHOD FOR A HIGH EFFICIENCY LOW NOISE HYDRAULIC PUMP/MOTOR

(71) Applicant: VOLVO CONSTRUCTION EQUIPMENT AB, Eskilstuna (SE)

(72) Inventors: Andreas Tonnqvist, Askim (SE); Jonas Forssell, Torslanda (SE); Jan-Ove Palmberg, Linköping (SE); Liselott Ericson, Linköping (SE); Anders Hedebjörn, Gothenburg (SE)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/215,569

(22) Filed: Mar. 29, 2021

(65) Prior Publication Data

US 2021/0215044 A1 Jul. 15, 2021

Related U.S. Application Data

(63) Continuation of application No. 16/440,134, filed on Jun. 13, 2019, now Pat. No. 10,968,741.

(Continued)

(51) Int. Cl.
*F01B 3/00* (2006.01)
*F01B 3/10* (2006.01)

(52) U.S. Cl.
CPC ..... *F01B 3/0035* (2013.01); *F01B 3/104* (2013.01)

(58) Field of Classification Search
CPC ..... F04B 1/22; F04B 1/303; F04B 3/0035; F04B 3/104; F01B 3/0035; F01B 3/104
See application file for complete search history.

(56) References Cited

U.S. PATENT DOCUMENTS 2,546,583 A 3/1951 Born
2,847,938 A 8/1958 Gondek
(Continued)

FOREIGN PATENT DOCUMENTS

EP 1519042 A1 3/2005
EP 2894294 A1 7/2015
(Continued)

OTHER PUBLICATIONS

Ericson L, Forssell J. A Novel Axial Piston Pump/Motor Principle With Floating Pistons: Design and Testing. ASME. Fluid Power Systems Technology, BATH/ASME 2018 Symposium on Fluid Power and Motion Control ( ): V001T01A067. doi:10.1115/FPMC2018-8937.

*Primary Examiner* — F Daniel Lopez
(74) *Attorney, Agent, or Firm* — Sage Patent Group

(57) ABSTRACT

A rotary displacement piston pump is disclosed having rotatable single or dual valve/port plate(s). The valve plate, being rotatable forward and/or rearward with respect to the rotation of the piston carrier, alters the phasing of the land area of the pumping action thereby altering the phasing of piston speed inasmuch as the land area can be moved to a position to accelerate the piston(s) in a pre or decompression phase. In this way, pump noise, from colliding pressure fronts within the respective high and low pressure plenums, can be "tuned" out of the pump by adjusting the phasing and position of the valve plate(s) and raising or lowering the pre and decompression pressure(s) as necessary. Pump volume can also be controlled by advancing or retarding the valve plate(s), either in or out of synch, so as to shorten intake/exhaust piston stroke and overlap fluid flow between respective intake/exhaust plenums.

27 Claims, 6 Drawing Sheets

Related U.S. Application Data

(60) Provisional application No. 62/802,884, filed on Feb. 8, 2019.

(56) References Cited

U.S. PATENT DOCUMENTS

| | | | | |
|---|---|---|---|---|
| 3,175,508 | A | 3/1965 | Smithson | |
| 3,204,569 | A * | 9/1965 | Firth | F01B 3/104 91/482 |
| 3,208,397 | A | 9/1965 | Lehrer et al. | |
| 3,265,008 | A * | 8/1966 | Ward | F01B 3/0035 91/490 |
| 3,621,761 | A * | 11/1971 | Alderspn | F01B 3/0035 91/491 |
| 5,220,225 | A | 6/1993 | Moon, Jr. | |
| 7,470,116 | B2 | 12/2008 | Dantlgraber | |
| 10,400,742 | B2 | 9/2019 | Galfre et al. | |
| 10,495,074 | B2 | 12/2019 | Friedrichsen et al. | |
| 10,590,920 | B2 | 3/2020 | Friedrichsen et al. | |
| 10,968,741 | B2 * | 4/2021 | Tonnqvist | F04B 1/324 |
| 2015/0198156 | A1 | 7/2015 | Odenmarck et al. | |
| 2015/0198158 | A1 | 7/2015 | Forsell et al. | |
| 2015/0240636 | A1 | 8/2015 | Kato et al. | |
| 2015/0260153 | A1 | 9/2015 | Kato et al. | |
| 2017/0152832 | A1 | 6/2017 | Galfre' et al. | |
| 2017/0276124 | A1 | 9/2017 | Sink et al. | |
| 2020/0256332 | A1 | 8/2020 | Tonnqvist et al. | |

FOREIGN PATENT DOCUMENTS

| | | | |
|---|---|---|---|
| EP | 2894295 | A1 | 7/2015 |
| EP | 3150851 | A1 | 4/2017 |
| EP | 3150852 | A1 | 4/2017 |

* cited by examiner

MECHANISM AND METHOD FOR A HIGH EFFICIENCY LOW NOISE HYDRAULIC PUMP/MOTOR

CROSS-REFERENCE TO RELATED APPLICATIONS AND CLAIM TO PRIORITY

This application is a continuation of U.S. patent application Ser. No. 16/440,134 filed Jun. 13, 2019, now U.S. Pat. No. 10,968,741, issued on Apr. 6, 2021, and claims the benefit of priority of provisional application 62/802,884 filed Feb. 8, 2019, the disclosures of which are herewith incorporated by reference in their entireties.

TECHNICAL FIELD

The invention relates to the field of hydraulic displacement pumps. Specifically, the invention relates to a hydraulic displacement pump including a rotatable valve plate that, upon advancing or retarding movement thereof, can vary pump throughput capacity and the effect(s) of pre and de-compression on pump operational noise.

BACKGROUND ART

Swashplate type pumps are known. A series of pistons are actuated by the coordinated engagement of a rotating member that causes the respective discrete pump pistons to engage in successive serial suction/compression strokes as the rotating member spins. The pistons can be mounted so as to spin about a collective axis against a fixed axially tilted plate so as to create piston movement or, the pistons themselves can be rotationally fixed and the tipped actuator can be made to spin and thus axially drive and reciprocate the successive pistons. In either case, a disk-shaped valve plate is present on the suction/compression sides of the pistons, and alternately exposes the respective pistons to an intake (low pressure side) plenum and an exhaust (high pressure side) plenum. Fluid moves through the pump at a rate corresponding to the rate of spin of the pump. The faster it rotates, the more "displaced" volume occurs through the collective movement of the pistons.

In these type of pumps, certain operational issues can occur. One of the issues is "noise". In operation, the respective pistons run in a sinusoidal motion by virtue of imparted motion from the actuator. At the moment of least movement, moving across the "land" portion of the actuator and valve/port plate, i.e., at the ends/beginnings of each successive stroke of the piston, the piston is moving from intake, low pressure, to the output, high pressure side, or vice versa, from high pressure to the low pressure side. In each such instance, the piston chamber brings with it the residual pressure of the last plenum, high pressure or low, with which it was just associated. However, once the pistons move off the "land" feature of the valve plate, the piston chamber is exposed to whatever pressure is present in the next plenum with which it is in fluid communication. This would be either a much higher pressure or much lower pressure. In the case of transition from low to high pressure, the pump exhibits a "noise" as the high pressure fluid present in the plenum forces itself against the relatively lower intake pressure of fluid present in the piston chamber, or vice versa, proceeding from high to low. This pressure difference is a natural consequence of this type of pump.

SUMMARY OF THE INVENTION

The present invention is a hydraulic displacement pump control system that provides a movable valve/port plate that can shift the plate forward or rearward, in rotation, with respect to its usual fixed position. In this way, the usual land area of the valve plate, where neither intake nor output is occurring, is shifted to a zone of accelerating piston actuation wherein the piston can pre-compress the fluid, in the case of transition from intake to output, or can de-compress the fluid in the case of transition from output to intake. In this way, respective noise(s) made by the relatively high pressure differentials between the piston chamber and the respective plenum chambers can be substantially reduced and eliminated.

In addition to the foregoing elimination of noise during operation, the output of the pump can be varied without the need to vary the speed of the pump overall. For noise reduction, shifting the "land" portions of the valve plate, i.e., in synch or somewhat opposed, noise can be "tuned out" and reduced. When one or more of the respective valve plates are moved in the same direction by up to 90 degrees with respect to conventional operational position, or out of synch, one plate with respect to the other, by up to 90 degrees, the pump output/intake volume can be reduced to zero.

The mechanism of the present pump can be applied to a hydraulic displacement pump of the type wherein the valve plate is retained in a relatively a fixed position, with respect to the spinning portions of the pump containing the pistons, and is only incrementally angularly advanced or retarded in position with respect to the directional rotation of the piston(s) moving past the valve plate. The land portion of the valve plate being shiftable forward or rearward, with respect to the timing of the passing piston chambers, controls the pump volume. The angle difference between the respective valve plates controls the effective land length and therefor the amount of pre- or de-compression. The changing angle of the valve plates not only changes the angular position of the land area with respect to the passing pistons but also changes the slope of land area within the pump, i.e., its position/function of imparting motion to the respective pistons along the track of their sinusoidal motion curve. As the slope effect of the valve plate, i.e., by virtue of its changed angular position, its effect on piston position is likewise altered and, thereby, the effect on pre and de-compression is increased and decreased.

BRIEF DESCRIPTION OF THE DRAWINGS

The foregoing background and summary, as well as the following detailed description, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DESCRIPTION OF EMBODIMENTS

Figure 1:
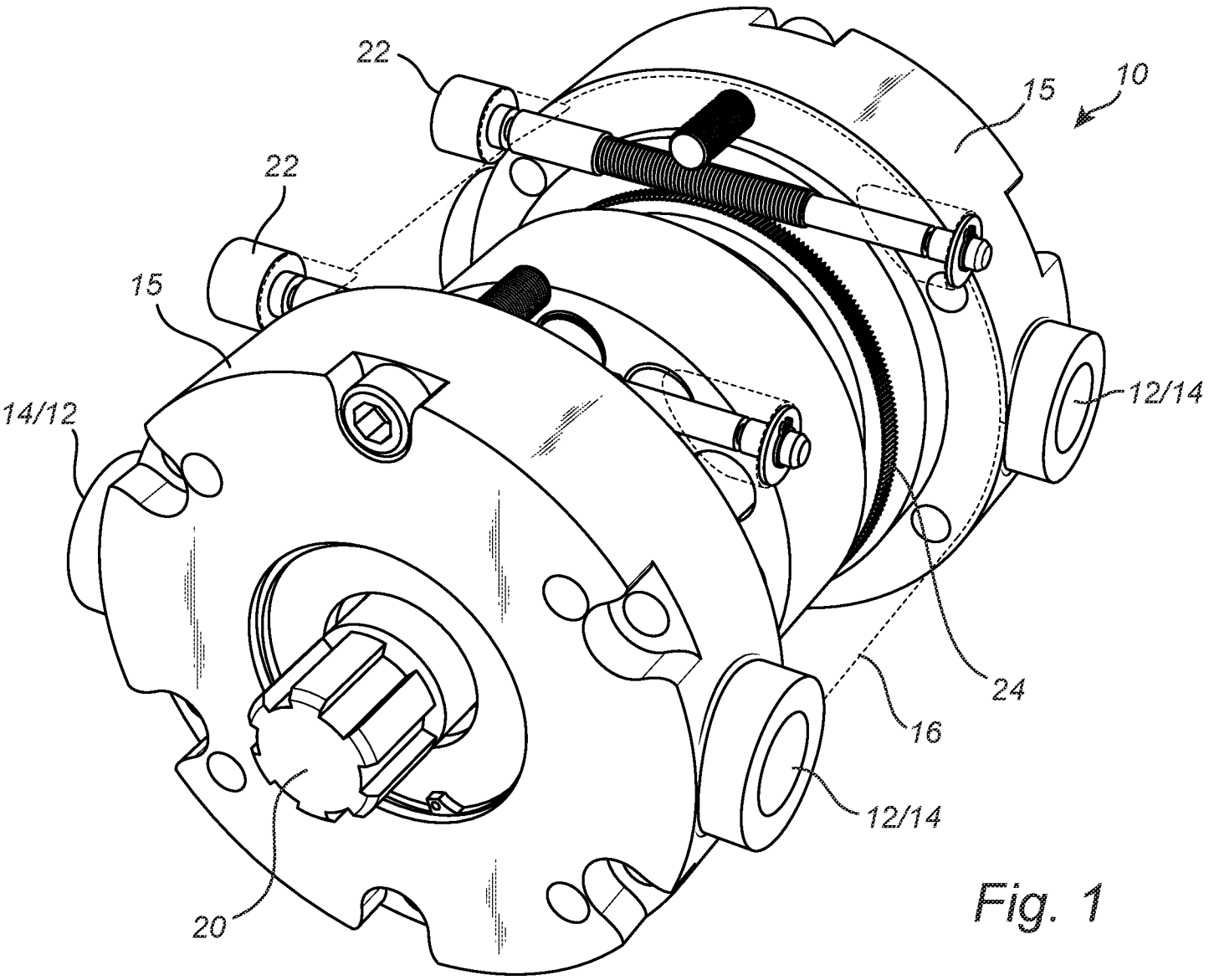
FIG. 1 is a perspective view of a pump in accord with the present invention, wherein the center portion of the outer casing is translucent so as to show the various components inside the casing.

The exemplary embodiment of the present invention will now be described with the reference to accompanying drawings. The following description of the preferred embodiment is merely exemplary in nature and is in no way intended to limit the invention, its application, or uses.

For purposes of the following description, certain terminology is used in the following description for convenience only and is not limiting. The characterizations of various components and orientations described herein as being "front," "back," "vertical," "horizontal," "upright," "right," 'left," "side," "top," "bottom," "above," "below," or the like designate directions in the drawings to which reference is made and are relative characterizations only based upon the particular position or orientation of a given component as illustrated. These terms shall not be regarded as limiting the invention. The words "downward" and "upward" refer to position in a vertical direction relative to a geometric center of the apparatus of the present invention and designated parts thereof. The terminology includes the words above specifically mentioned, derivatives thereof and words of similar import.

Figure 2A:
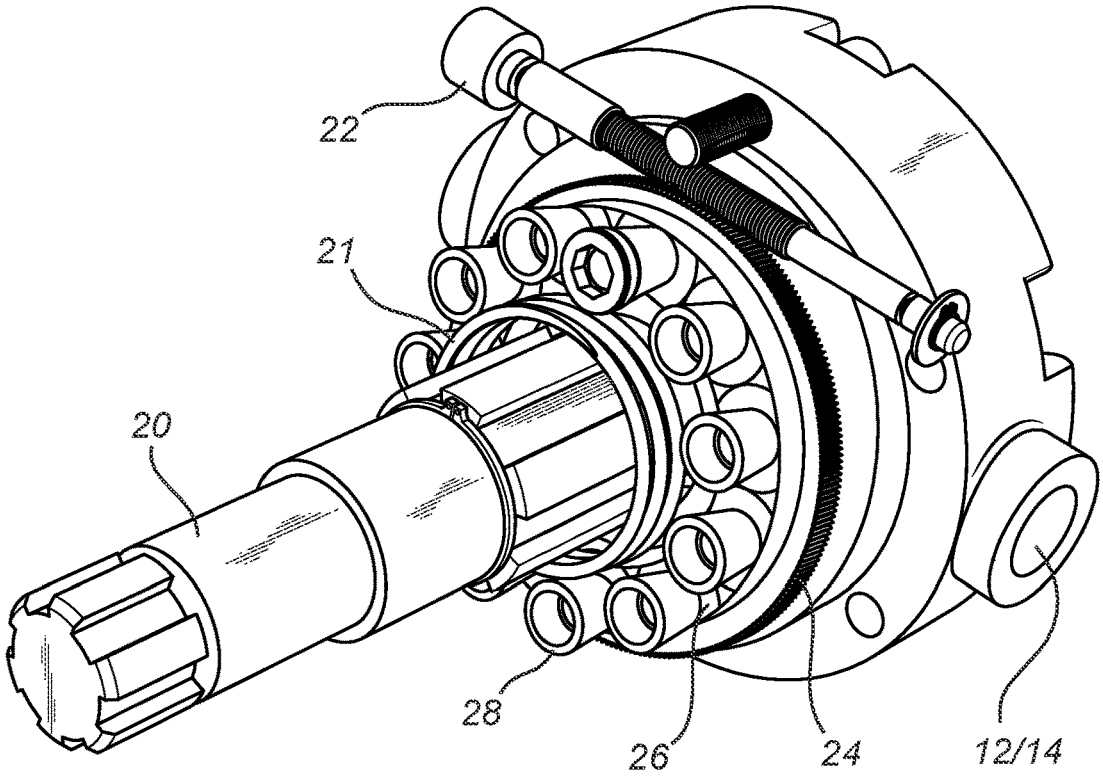
FIG. 2A shows a portion of the pump assembly with the floating piston plate in position.
Figure 2B:
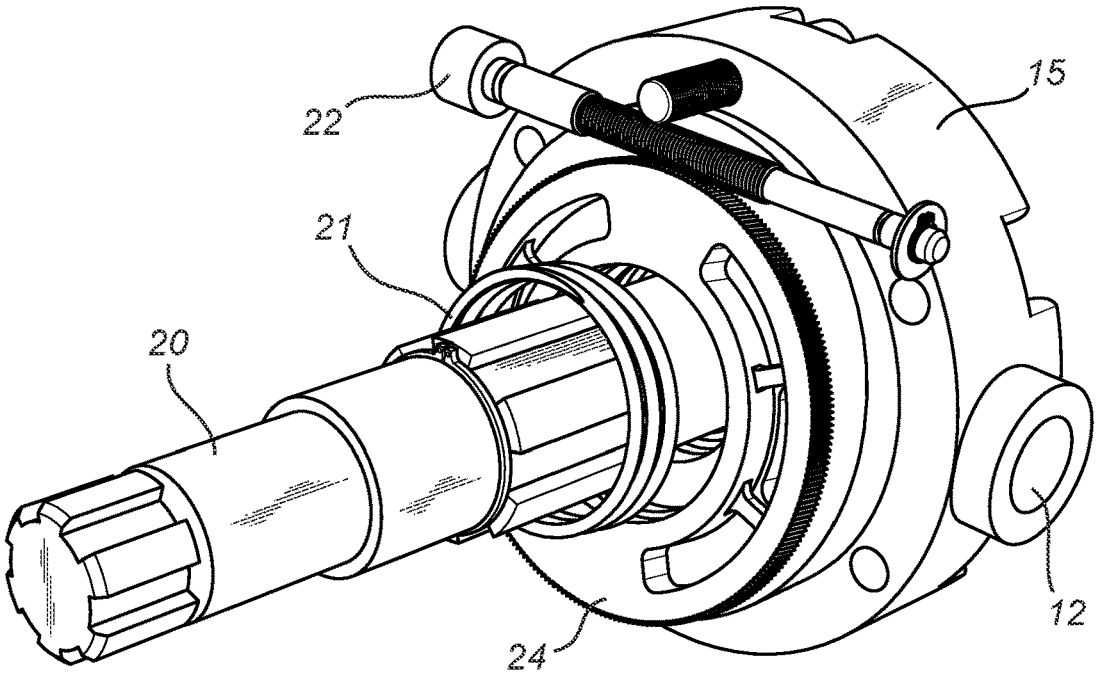
FIG. 2B shows a portion of the pump assembly with the valve plate exposed.
Figure 2C:
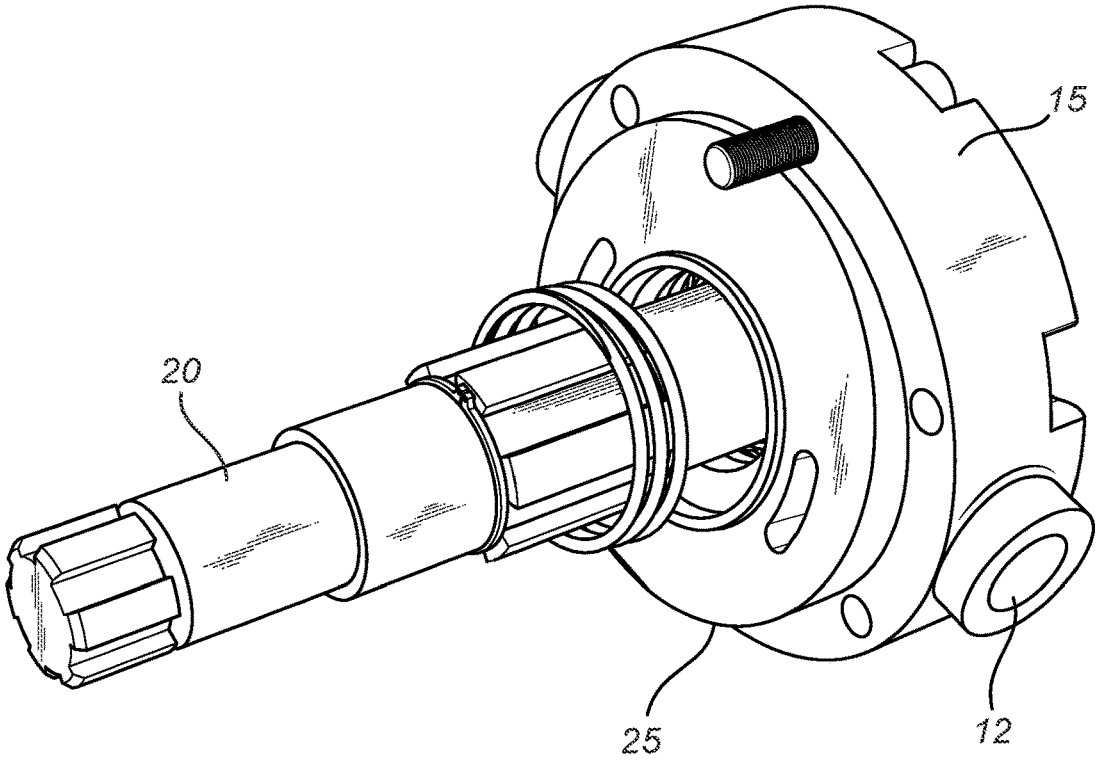
FIG. 2C shows a portion of the pump assembly with the valve plate removed and the intake/exhaust plenum exposed.
Figure 3:
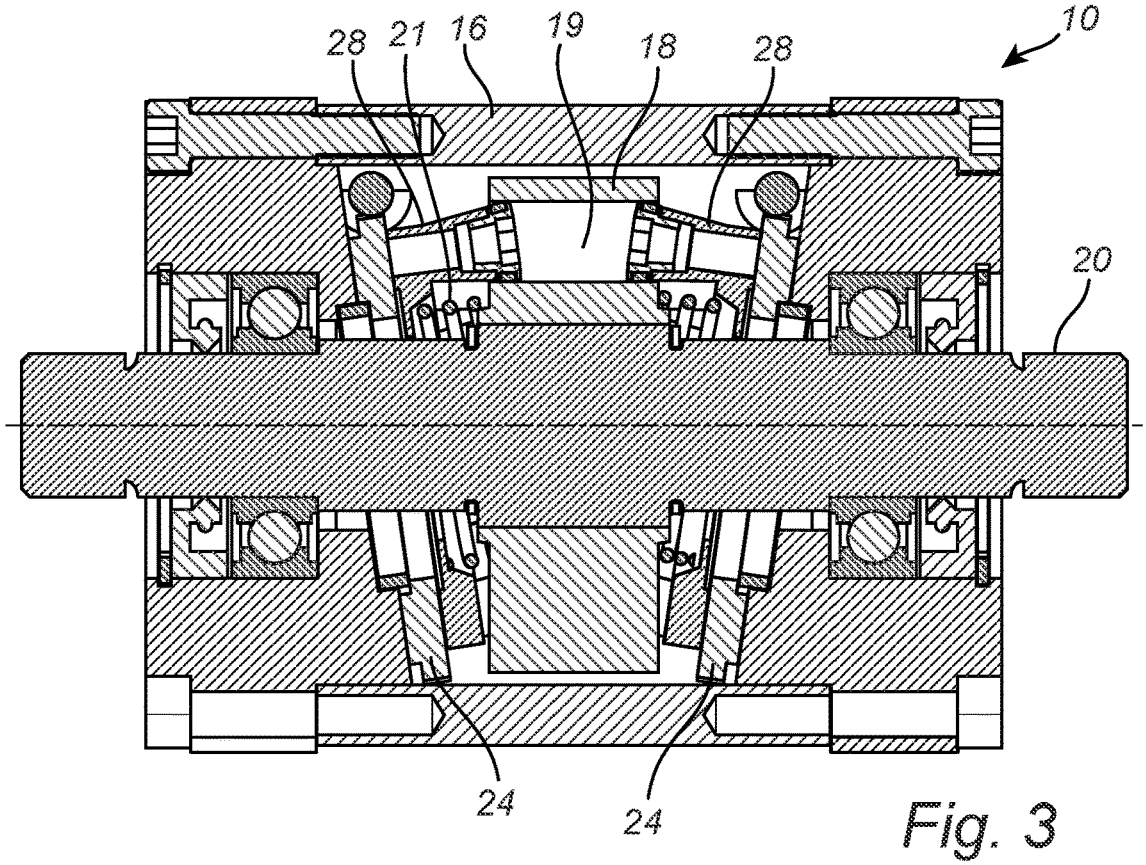
FIG. 3 shows a sectional view of a pump assembly in accord with FIG. 1.

FIGS. 1-3 show a pump 10 that embodies the principles and mechanisms of the present invention. The pump is made up of an outer casing or housing that includes a pair of end housing elements 15 and a center portion 16. In FIG. 1 the center housing portion 16 is shown as translucent so that the inner workings of the pump can be revealed. The pump 10 is driven by axle/spindle 20 that can be rotated in either direction. The axle 20 is connected to and rotates the piston carrier 18 that contains each of the pressure chambers 19 that each piston 28 inserts within and, by virtue of being driven by action of the floating piston plate 26 along the axially tilted surface of the valve/port plate 24, the respective pistons 28 are driven into and out of chambers 19. The floating piston plate 26 is urged against the valve plate 24 via coil spring 21 which maintains the floating piston plate 26 in an outward biased condition against the valve plate 24 when the pump axle 20 rotates. The pistons 28 insert at a changing alignment angle within the piston carrier 18. As the piston is urged in and out of the pressure chamber, the angle axially steepens with respect to the axis of axle 20 when the piston is fully extended towards the valve plate 24 and is most aligned with the chamber 19 axis at full piston 28 insertion into the piston carrier 18.

Each housing end element 15 includes an inlet 12 and an outlet 14, which can be reversed in function depending on the direction of rotation of the axle 20. The respective inlet/outlets are in fluid communication with plenum 25. The plenum 25 directs fluid from behind the valve plate from an inlet 12 to an outlet 14 and through valve plate 24. The fluid passes into and through the hollow pistons 28 into chamber (s) 19. When the volume of this chamber 19 expands via the pistons 28 respectively being pulled outward by action of floating piston plate 26 (biased by springs 21), a negative or vacuum pressure draws fluids from an intake 12/14 through the plenum 25 and valve plate 24 and into the chamber 19. In the same way, when the chamber 19 is reduced in volume by the respective pistons 28 being urged one toward the other toward the center of the chamber 19 by action of the floating piston plate 26 against the tilted valve plate 24, fluid is squeezed from chamber 19 through valve plate 24 and out through the plenum 25.

The plenum 25, as noted, functions to pass fluids to and through the valve plate 24. The valve plate 24 has two arcuate passageways 29 around its perimeter. These passageways 29 and the land areas 27 therebetween, define and separate the low pressure and high pressure sides of the pump 10. As the chamber 19 volume expands, the pistons 28 and associated one of chambers 19 are fed through the low pressure side of plenum 25 as long as the piston(s) respectively align with the associated arcuate passageway 29 in valve plate 24. When the piston(s) 28 reaches top center of the valve plate 24, it has drawn in as much fluid as it can, and is then sealed momentarily against land area 27 of the valve plate 24. Once the piston 28 slides past the land area 27, the piston then begins a compression stroke and high pressure fluid exits the chamber(s) through an opposed arcuate passageway 29 associated with the high pressure side of the plenum 25. When the piston has fully compressed and squeezed fluid to the extent that it can out of chamber 19, having reached bottom center, it will again reach a land area 27 where it is sealed off momentarily from the high and low pressure sides, and then begin the cycle again as it travels along the intake side of plenum 25 again.

Figure 4:
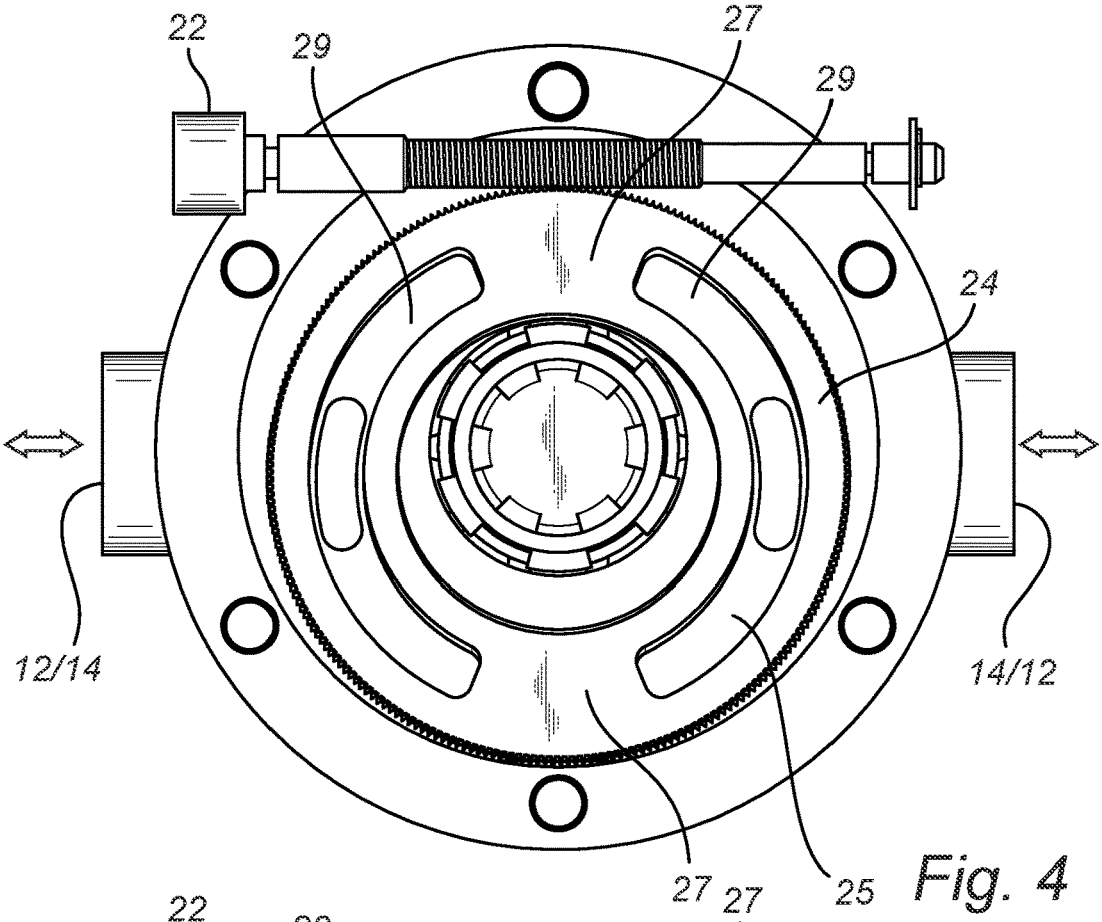
FIG. 4 shows an end view of the valve plate and actuator in accord with the present invention
Figure 5:
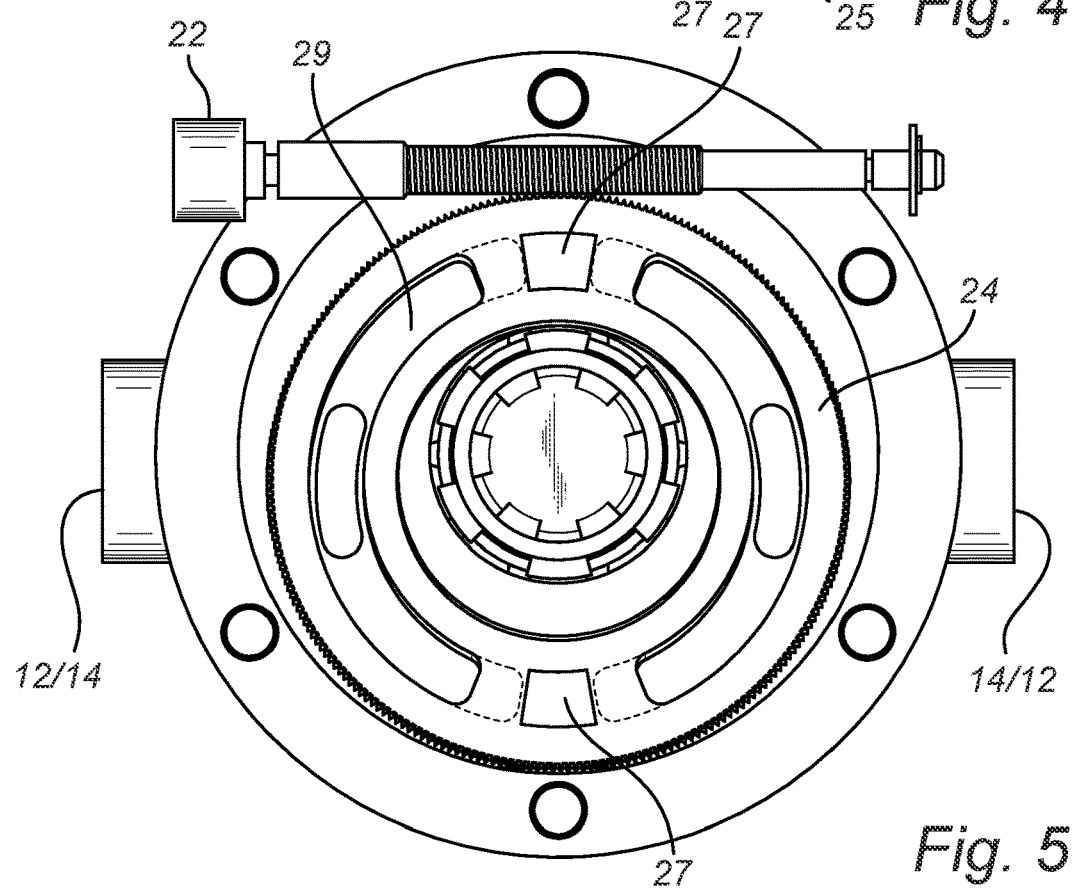
FIG. 5 shows the valve plate of FIG. 4 in a rotated/shifted position.

FIGS. 4 and 5 show the valve plate 24 being actuated by worm driver 22 along the toothed perimeter of the valve plate 24. In FIG. 4, the pump piston floating plate 26 is rotating against valve plate 24 in a counter clockwise direction. Fluid is drawn in through the low pressure side of plenum 25 and is pumped out on the high pressure side. The piston(s) 28, carried via the floating piston carrier 26, and bear against the valve plate 24. As the pistons 28 ride up the right side of FIG. 4, the chamber 19 expands as the pistons are drawn out of the chamber and create a suction pressure condition within the associated chamber 19 and the low pressure side of plenum 25. The speed of the piston as it pulls out of the chamber 19 accelerates from bottom center through the midportion of the its circular route along valve plate 24 and then, past the midportion, slows again as it approaches the top center land area of valve plate 24. While the piston travels across the land area 24, it is relatively motionless as to pumping action and remains sealed against the valve plate land area 27. Once the piston 28 moves past the land area 27 at top center, it is opened to the high pressure side of the plenum 25. The piston 28, just as it did on the low pressure side, now accelerates in compression as it rides down the left side of the valve plate 24 shown in FIG. 4. This piston 28 acceleration ceases past the mid-point of its circular route back down to bottom center where it is again motionless, at least as to pumping action, as it passes, sealed, against the bottom land area 27.

In FIG. 5, the worm driver 22 has shifted one or both valve plates one with respect to the other. When shifted in a counter direction, one valve plate 24 to the other, the net effect is to shorten the total "effective" land area at top and bottom center 27 of the valve plate 24. If the valve plate 24 is shifted counter clockwise, i.e., in the direction of pump rotation, as seen in FIG. 5, the piston, having passed through top center, the land area is now increasing in "slope" and has, as such, already begun to accelerate an associated piston to create pressure while it remains sealed against the land area 27. In this way, the pressure ramps up rapidly in the still sealed chamber and, thereafter, counteracts the high pressure fluid influx from the high pressure side of the plenum 25 when the piston is continuing to accelerate past the land area and is then open to the high pressure side of the plenum. By more rapidly equalizing pressure, and from a higher starting pressure point, operational noise created by widely differing fluid pressure fronts colliding within the high pressure side of the plenum is eliminated. At the same time, at the opposed side of the valve plate 24, it has the identical but opposite effect of allowing the piston to be shifted to an accelerating phase of decompression/vacuum and, in so doing, decompresses the remaining fluid in the chamber, residual from the high pressure side of the plenum 25, before passing off the land area and into fluid communication with the low pressure side of the plenum 25. This also eliminates pump operational noise from colliding fluid pressure wave fronts existing on the low pressure side of the plenum.

Pump volume control can be affected by rotating the respective valve plates 24 in synch forwardly or rearwardly. Where the respective valve plates 24 are both rotated in synch 90 degrees to the top and bottom center, the pumping action ceases inasmuch as the both low and high pressure sides of the plenum are open one to the other Likewise, if the valve plates are rotated too much out-of-phase, the effective land area is reduced to zero and cross flow from the high to low pressure plenums would occur.

FIG. 6-10 show schematics of piston action/stroke position vis-à-vis the positions of the respective valve plates, in this dual valve plate/dual piston per chamber embodiment of the invention. (Note: If this were not a "dual piston" pump, as shown, and was, instead, using single respective pistons operating from a single side, only the upper or lower portion(s) of the respective schematics would apply.)

Figure 6:
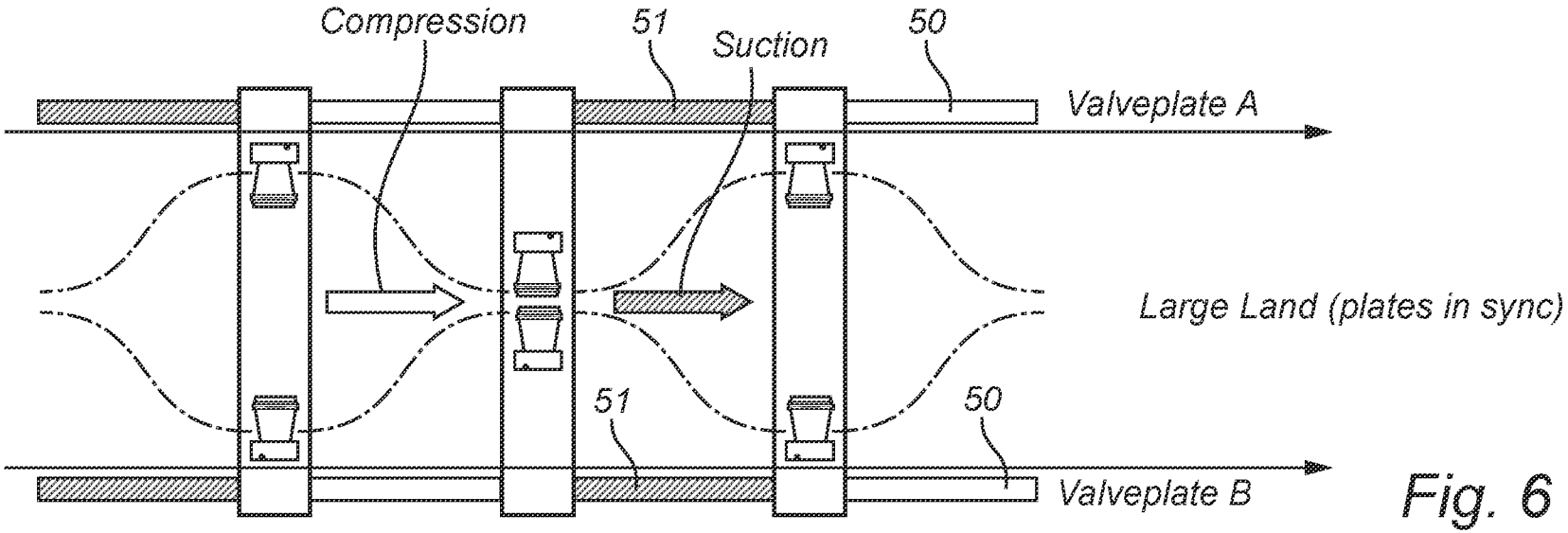
FIG. 6 is a schematic depiction of pump intake/output piston movement with the valve plates in synch in normal operation.
Figure 7:
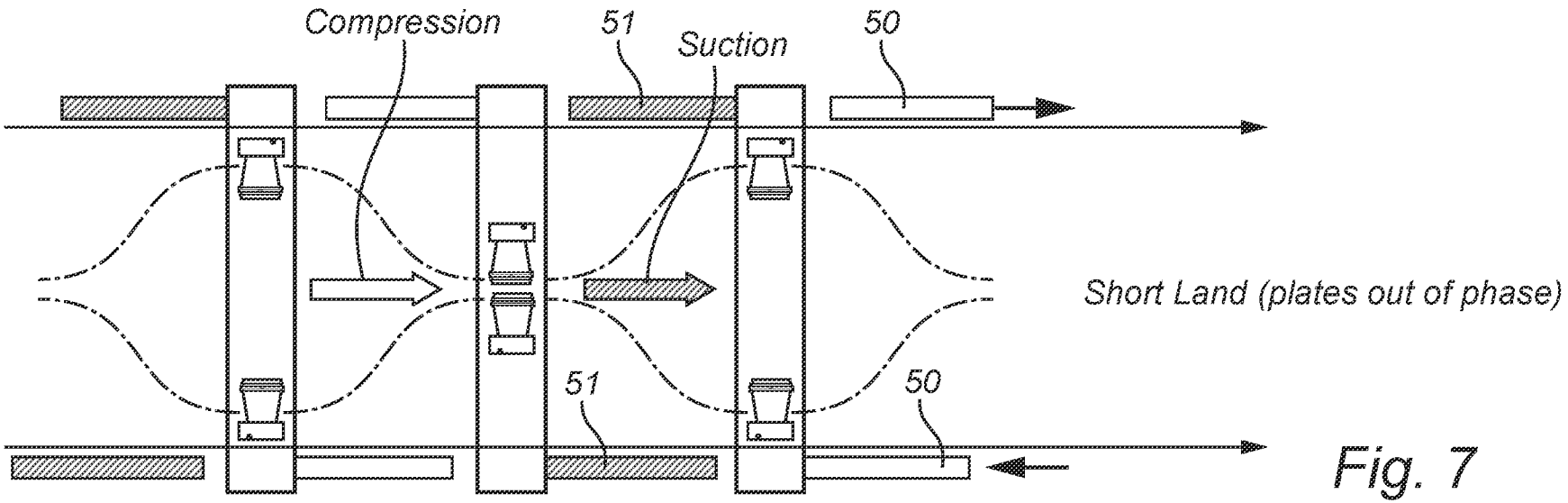
FIG. 7 is a schematic depiction of pump intake/output piston movement with the valve plates out of phase.
Figure 8:
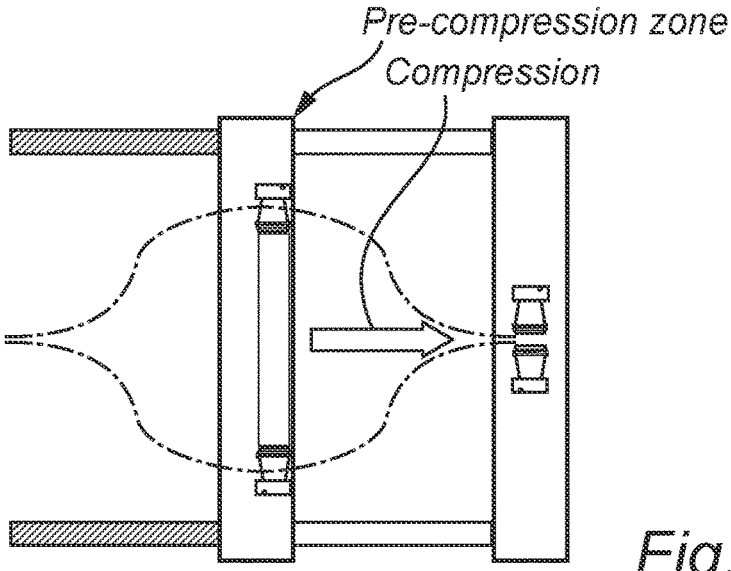
FIG. 8 is a schematic depiction of the effect on piston motion vis-à-vis the "land" portion of the valve plate so as to effect pre and de-compression of the pumped fluid.
Figure 9:
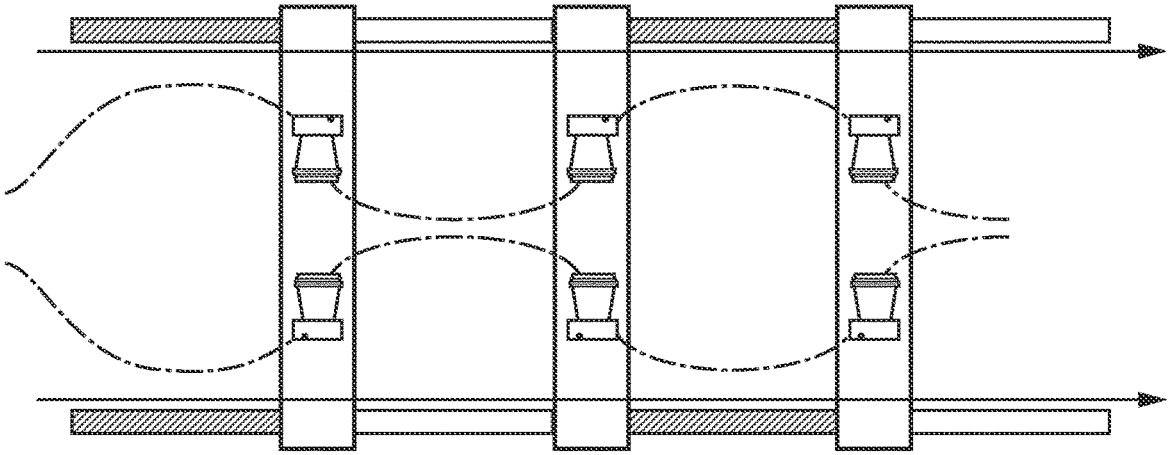
FIG. 9 is a schematic showing pump piston travel varying pump volume using considerable in synch valve plate rotation whilst operating the pump at a fixed speed. Little or no pump output is achieved.
Figure 10:
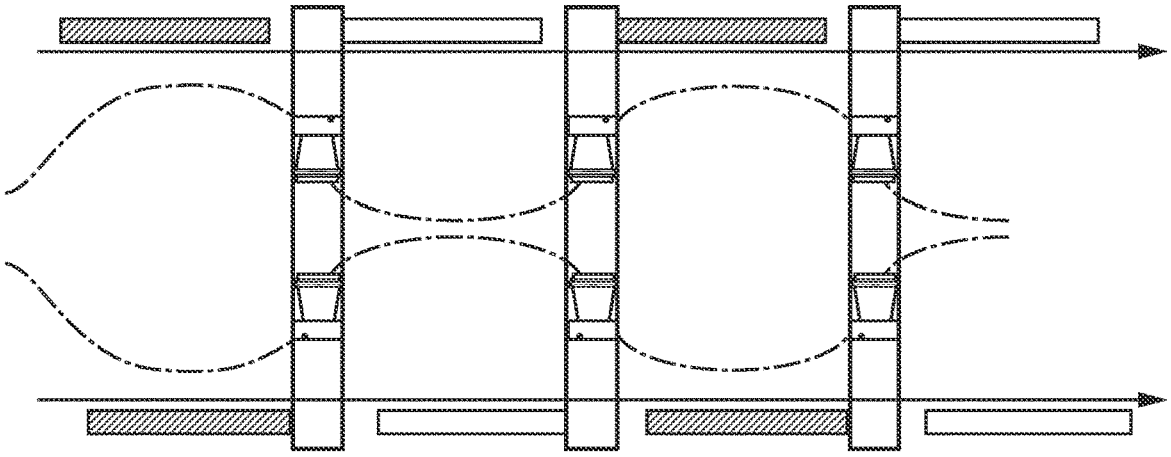
FIG. 10 shows an altered schematic of piston action from FIG. 9 wherein the valve plates are not in phase and the effective length of the land is shorter, providing a much smaller precompression.

FIG. 6 shows "normal" pump operation and piston action, equal length intake 51 and compression 50 zones of movement, as the pistons move in synch and ride along the tipped valve plate 24 and are held in position via the floating piston plate 26. The land area corresponds to the particular configuration of the valve plate 24, and both valve plates at each end of the dual pump are in the same relative opposed positions. In FIG. 7, one valve plate 24 is advanced/retarded with respect the other in an opposed direction, thus shortening the effective land area of the pump, and increasing the acceleration rate of the piston on one side of the chamber vis-à-vis the piston on the opposite end of a given chamber 19. Hence, when the piston at one end of the chamber is still riding on the land area, it has already begun ramping up/decreasing pressure because the land area has been moved and is now sloped vis-à-vis the passing piston(s). FIG. 8 shows how shifting the land area of the valve plate 24 enables the piston to perform pre-compression by accelerating along the increasing slope of the shifted valve plate 24 land area so as to eliminate noise. FIG. 9 shows the piston movement when valve plates 24 are shifted, in synch, a full 90 degrees to where the piston is experiencing it highest speed of sloped valve plate induced movement whilst crossing the land area of the valve plate 24. This is not a good long-term operational condition for the pump inasmuch as too much pre-compression occurs. It works better when the respective valve plates are not identically phased in this low or no-flow condition. FIG. 10 again shows piston movements with the respective valve plates 24 shifted one slightly counter to the other in opposite directions, but still at an approximately full 90 degree rotation as in FIG. 9 when compared to their starting position in FIG. 6. This creates a shorter "effective land" condition in a low flow or no flow condition, and requires adjustment to accommodate fluid flow, pump speed, fluid type (i.e., compressibility) to reduce noise and control flow.

Although certain presently preferred embodiments of the invention have been specifically described herein, it will be apparent to those skilled in the art to which the invention pertains that variations and modifications of the various embodiments shown and described herein may be made without departing from the spirit and scope of the invention. For example, the foregoing principles of an incrementable valve plate 24 can be applied to a displacement pump 10 using a single valve plate, and pistons fed from one only one side. The preferred embodiment shown includes a dual valve plate control.

The invention claimed is:

1. A hydraulic pump, comprising:

a pump casing;

an axle extending into the pump casing;

a piston carrier within the pump casing and affixed to the axle, wherein the piston carrier rotates in response to rotation of the axle, and wherein the piston carrier comprises a pressure chamber therein; and first and second opposing hollow pistons mounted in the piston carrier, wherein the first and second hollow pistons are urged into and out of the pressure chamber in response to rotation of the piston carrier;

wherein each of the first and second hollow pistons are fluidly coupled to respective inlets in the pump casing at a first angular position of the piston carrier and are fluidly coupled to respective outlets in the pump casing at a second angular position of the piston carrier.

2. The hydraulic pump of claim 1, wherein the hollow pistons are configured to insert into and retract from the piston carrier at an angle relative to an axis of the axle.

3. The hydraulic pump of claim 1, further comprising a pair of valve plates on opposing sides of the piston carrier, wherein the valve plates are axially tilted relative to the axle, wherein the hollow pistons are connected to respective piston plates, and wherein the piston plates contact respective ones of the axially tilted valve plates and wherein the hollow pistons are driven into and out of the pressure chamber as a result of the piston plates being rotated against the axially tilted valve plates.

4. The hydraulic pump of claim 3, wherein the pump casing comprises a pair of housing end elements on opposite sides of the pressure chamber, each of the housing end elements comprising an axially tilted surface in contact with a respective one of the axially tilted valve plates and comprising a first opening in fluid communication with one of the respective inlets in the pump casing and a second opening in fluid communication with one of the respective outlets in the pump casing.

5. The hydraulic pump of claim 4, further comprising:

first and second piston plates on opposite sides of the piston carrier, wherein each of the opposing hollow pistons is affixed to respective ones of the first and second piston plates, wherein the first and second piston plates are axially tilted relative to the axle at tilt angles defined by the axially tilted surfaces of the housing end elements, and wherein the first and second piston plates rotate together with the piston carrier.

6. The hydraulic pump of claim 5, wherein a first plurality of hollow pistons including the first hollow piston are mounted to the first piston plate and a second plurality of hollow pistons including the second hollow piston are mounted to the second piston plate, each of the hollow pistons of the first and second plurality of hollow pistons extending into a respective pressure chamber in the piston carrier.

7. The hydraulic pump of claim 1, wherein each of the opposing hollow pistons has a conical shape.

8. The hydraulic pump of claim 1, wherein each of the opposing hollow pistons inserts into the pressure chamber at an angle relative to the axle.

9. The hydraulic pump of claim 1, further comprising:

a valve plate adjacent the piston carrier, wherein the valve plate is axially tilted relative to the axle and the piston carrier, and wherein the valve plate comprises first and second passageways therethrough and first and second land areas between the passageways, wherein rotation of the piston carrier causes a first one of the opposing hollow pistons to be urged into and out of the pressure chamber, and causes the first one of the opposing hollow pistons to pass alternately over the passageways and the land areas.

10. The hydraulic pump of claim 9, wherein of the first hollow piston is fluidly coupled to one of the respective inlets in the pump casing at the first angular position of the piston carrier through the first passageway and is fluidly coupled to one of the respective outlets in the pump casing at the second angular position of the piston carrier through the second passageway.

11. The hydraulic pump of claim 9, wherein when rotation of the piston carrier causes the hollow piston to be positioned adjacent the first passageway, the pressure chamber is in fluid communication with one of the respective inlets, and when rotation of the piston carrier causes the hollow piston to be positioned adjacent the first land area or the second land area, the pressure chamber is sealed from the one of the respective inlets.

12. The hydraulic pump of claim 11, wherein the valve plate is rotatable relative to the pump casing.

13. The hydraulic pump of claim 12, further comprising a threaded worm driver mounted to the pump casing, wherein the valve plate comprises a toothed perimeter that engages the threaded worm driver, wherein actuation of the threaded worm driver causes rotation of the valve plate relative to the pump casing.

14. The hydraulic pump of claim 9, further comprising:

a piston plate between the hollow piston and the valve plate, wherein the first one of the opposing hollow pistons is affixed to the piston plate; and a bias spring between the piston carrier and the piston plate that urges the piston plate outwardly into contact with the valve plate.

15. The hydraulic pump of claim 9, wherein the first and second passageways comprise arcuate apertures through the valve plate.

16. The hydraulic pump of claim 15, wherein the valve plate is rotatable to an angular position in which one of the respective inlets and one of the respective outlets are in fluid communication with one another through the passageway.

17. The hydraulic pump of claim 9, wherein when rotation of the piston carrier causes the hollow piston to be positioned adjacent the second passageway, the pressure chamber is in fluid communication with one of the respective outlets.

18. A method of controlling noise in a hydraulic pump, the hydraulic pump including a rotating piston carrier mounted within a pump casing, the rotating piston carrier including piston chambers with hollow pistons therein, one of the hollow pistons being driven into and out of a pressure chamber in the piston carrier in a reciprocating fashion in response to rotation of the rotating piston carrier by an axially tilted valve plate positioned adjacent the rotating piston carrier, the method comprising:

rotating the valve plate relative to the pump casing to adjust an angular position at which the hollow pistons pass over a passageway in the valve plate that fluidly couples the hollow pistons to an outlet of the hydraulic pump.

19. The method of claim 18, wherein adjusting the angular position at which the hollow pistons pass over the passageway in the valve plate induces pre-compression within the respective piston chambers before passing over the passageway during pump operation.

20. The method of claim 18, wherein the valve plate comprises a toothed perimeter, and wherein rotating the valve plate comprises engaging the toothed perimeter of the valve plate with a threaded worm driver.

21. The method of claim 18, wherein the valve plate comprises a first valve plate, the hydraulic pump comprises a second valve plate on an opposite side of the rotating piston carrier from the first valve plate, the method further comprising:

rotating the second valve plate relative to the pump casing independently of the first valve plate.

22. The method of claim 21, further comprising:

rotating the first valve plate and the second valve plate in opposite directions.

23. The method of claim 18, wherein:

the passageway comprises a first passageway;

the valve plate comprises a second passageway therethrough with a land area between the first passageway and the second passageway; and the pump casing comprises an outlet in fluid communication with the first passageway and an inlet in fluid communication with the second passageway;

the method further comprising:

rotating the piston carrier to position a first hollow piston adjacent the second passageway so that the pressure chamber is in fluid communication with the outlet; and rotating the piston carrier to position the first hollow piston adjacent the land area so that the pressure chamber is sealed from the outlet.

24. The method of claim 23, wherein the valve plate is rotatable to an angular position in which the inlet and the outlet are in fluid communication with one another through at least the first passageway.

25. A hydraulic pump, comprising:

a pump casing;

an axle extending into the pump casing;

a piston carrier within the pump casing and affixed to the axle, wherein the piston carrier rotates in response to rotation of the axle, and wherein the piston carrier comprises a pressure chamber therein;

first and second hollow pistons mounted in the piston carrier at opposing sides of the piston carrier; and first and second valve plates on opposite sides of the piston carrier, wherein the first and second valve plates are axially tilted relative to the axle and the piston carrier, and wherein the first and second valve plates each comprise a respective passageway therethrough and a land area adjacent the passageway, wherein rotation of the piston carrier against the axially tilted first and second valve plates causes the respective first and second hollow pistons to be urged into and out of the pressure chamber, and causes the first and second hollow pistons to pass alternately over the passageways and the land areas of the first and second valve plates, respectively;

wherein the first and second valve plates are rotatable relative to the pump casing.

26. The hydraulic pump of claim 25, further comprising first and second threaded worm drivers mounted to the pump casing, wherein the first and second valve plates each comprise a toothed perimeter that engages a respective one of the threaded worm drivers, wherein actuation of the first and second threaded worm drivers causes rotation of the respective valve plate relative to the pump casing.

27. The hydraulic pump of claim 26, wherein the first and second valve plates are independently rotatable relative to the pump casing.

* * * * *